US007303434B1

(12) United States Patent
Chen et al.

(10) Patent No.: US 7,303,434 B1
(45) Date of Patent: Dec. 4, 2007

(54) MOUNTING DEVICE FOR CONNECTOR

(75) Inventors: Yun-Lung Chen, Taipei Hsien (TW); Yu-Ming Xiao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/681,197

(22) Filed: Mar. 2, 2007

(30) Foreign Application Priority Data

Dec. 6, 2006 (CN) ..... 2006 2 0016222

(51) Int. Cl.
*H01R 13/73* (2006.01)

(52) U.S. Cl. ..... 439/557

(58) Field of Classification Search ..... 439/557, 439/558, 556; 200/295; 148/27.3
See application file for complete search history.

(56) References Cited

U.S. PATENT DOCUMENTS

| | | | | |
|---|---|---|---|---|
| 5,810,614 | A * | 9/1998 | Ruch | 439/247 |
| 6,113,426 | A | 9/2000 | Lin | |
| 6,231,385 | B1 * | 5/2001 | Kuo | 439/557 |
| 6,307,756 | B1 | 10/2001 | Liu et al. | |
| 6,648,681 | B2 * | 11/2003 | Ushiro et al. | 439/557 |

* cited by examiner

*Primary Examiner*—Phuong Dinh
(74) *Attorney, Agent, or Firm*—Wei Te Chung

(57) ABSTRACT

A mounting device is used to mount a connector module to an enclosure. The enclosure includes a panel extending along a side thereof. The panel defines an opening for communicating an inside of the enclosure to outside the enclosure. A flange extends from an edge of the opening into the inside of the enclosure with the opening located beside one side of the flange. The panel defines a hole beside the other side of the flange. The connector module is removably attachable to the panel. The connector module includes a clasp on a side thereof. The connector module extends through the opening from outside the enclosure in such a manner that the clasp extends through the hole, and is kept a distance from the connector module by the flange and engages with the flange to mount the connector module on the panel.

19 Claims, 3 Drawing Sheets

MOUNTING DEVICE FOR CONNECTOR

BACKGROUND OF THE INVENTION

1. Field of the Invention

The present invention relates to a mounting device, and more particularly to a mounting device for mounting a connector.

2. Description of Related Art

Connectors for transferring signals and power, such as USB (Universal Serial Bus) connectors and IEEE 1394 connectors, are soldered to a motherboard. Openings are defined in a panel of a computer enclosure to expose the connectors for connection with peripheral devices.

A typical connector mounting method is to directly screw the connector to the panel of the computer enclosure. However, manual pre-alignment with several different screw holes defined in the connector assembly, the mating connector, and the panel causes the installment of the connector to be inconvenient and time-consuming. Another mounting method is to rivet a connector on a panel of a computer enclosure. The connector forms a plurality of rivets. The panel defines a plurality of holes corresponding to the plurality of rivets. The rivets of the connector extend through the holes of the panel, and are riveted to the panel to secure the connector to the panel. However, when the connector needs to be disassembled from the computer enclosure, the rivets of the connector should be destroyed and the connector can't be used again.

SUMMARY OF THE INVENTION

A mounting device is used to mount a connector module to an enclosure. The enclosure includes a panel extending along a side thereof. The panel defines an opening for communicating an inside of the enclosure to outside the enclosure. A flange extends from an edge of the opening into the inside of the enclosure with the opening located beside one side of the flange. The panel defines a hole beside the other side of the flange. The connector module is removably attachable to the panel. The connector module includes a clasp on a side thereof. The connector module extends through the opening from outside the enclosure in such a manner that the clasp extends through the hole, and is kept a distance from the connector module by the flange and engages with the flange to mount the connector module on the panel.

Other advantages and novel features of the present invention will become more apparent from the following detailed description of preferred embodiment when taken in conjunction with the accompanying drawings, in which:

DETAILED DESCRIPTION OF THE INVENTION

Figure 1:
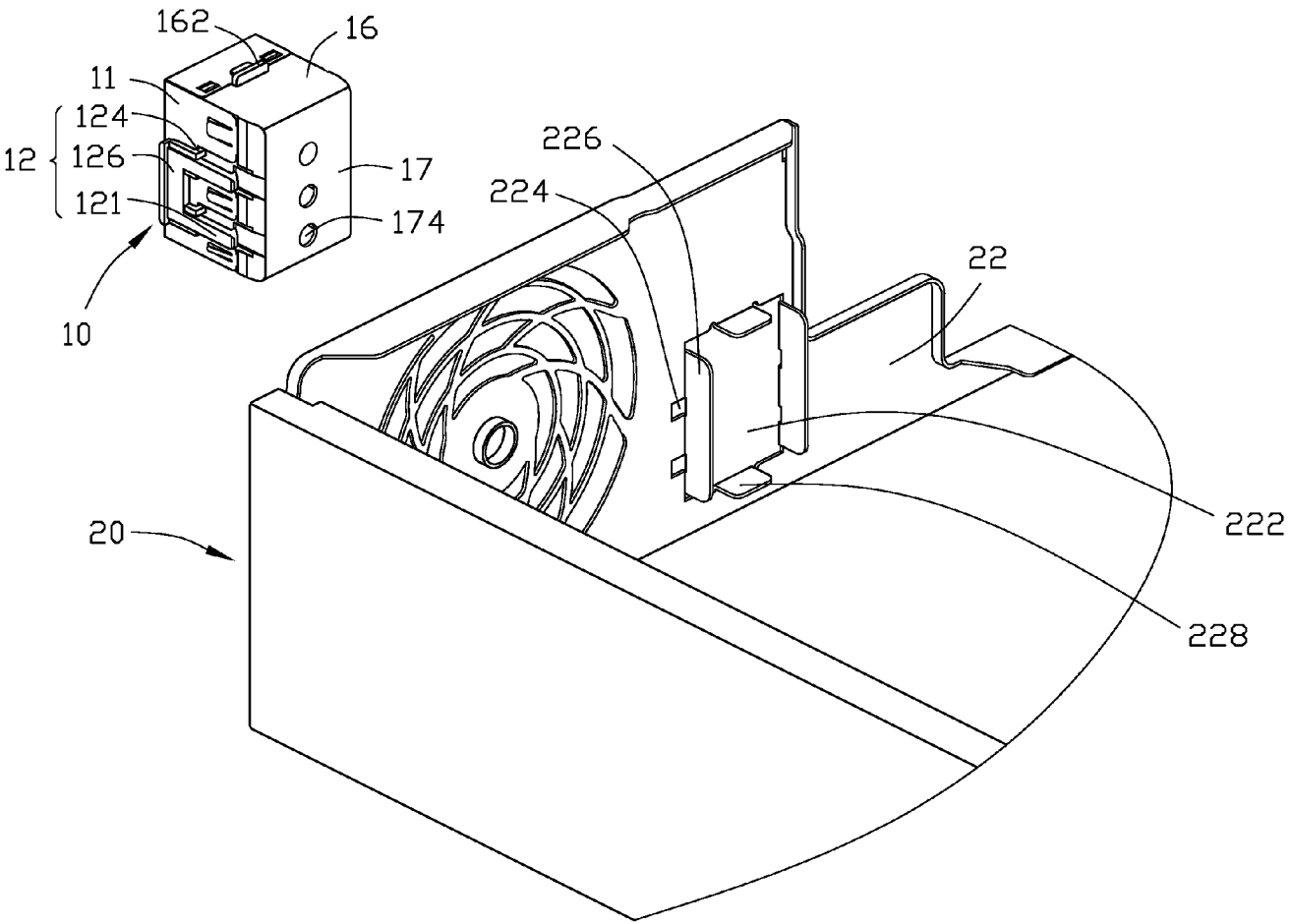
FIG. 1 is an exploded, isometric view of a preferred embodiment of a mounting apparatus which includes a shield pre-mounting connectors to a panel of a computer enclosure.

Referring to FIG. 1, a mounting device in accordance with a preferred embodiment of the present invention includes a shield 10. The shield 10 is hollow for receiving connectors (not shown) therein to form a connector module. The connector module is to be mounted to a panel 22 of a computer enclosure 20. The enclosure 20 is used to accommodate electronic devices, such as hard disk drives and a motherboard, therein.

The panel 22 extends along a side of the enclosure 20. An opening 222 is defined in the panel 22 to communicate an inside and an outer side of the enclosure 20. A pair of bent pieces 228 extends into the inside of the enclosure 20 from a top edge and a bottom edge of the opening 222 respectively. A pair of flanges 226 extends into the inside of the enclosure 20 from a left edge and a right edge of the opening 222 respectively. The panel 22 defines a pair of holes 224 beside each of the left edge and right edge of the opening 222, so that one side of each flange 226 is adjacent to a pair of holes 224, and the other side is adjacent to the opening 222.

Figure 2:
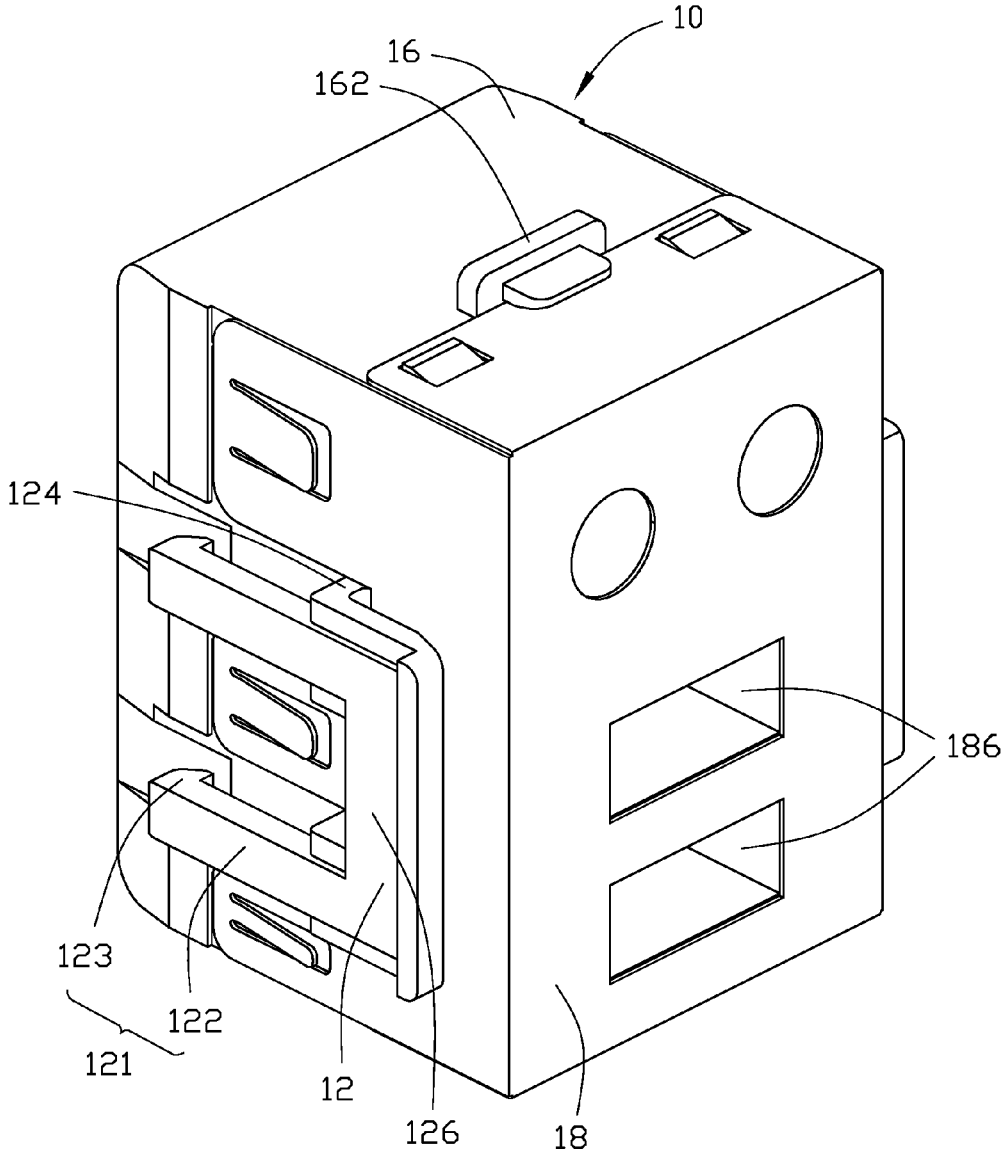
FIG. 2 is an isometric view of the shield of FIG. 1.

Referring to FIGS. 1 and 2, the shield 10 includes a top panel 16, an outer panel 18, an inner panel 17, and two side panels 11. Each side panel 11 forms a teeterboard-type actuating member 12 thereon. The actuating member 12 includes a main body with a pair of connecting portions 124 formed from a middle portion thereof to connect with the side panel 11. The connecting portions 124 are made of flexible material, and can be elastically bent. The main body is located parallel to the side panel 11. An outer portion of the main body of the actuating member 12 forms an operating portion 126, and an inner portion of the main body forms a pair of clasps 121. Each clasp 121 includes a resilient arm 122 connecting to the operating portion 126, and a barb 123 formed at a free end thereof. The outer panel 18 defines several slots 186 adapted for allowing access to the connectors in the shield 10. The inner panel 17 defines several coil insertion holes 174 for coils (not shown) extending therethrough to connect the connectors and signal sources (not shown). An area of the inner panel 17 is generally equal to an area of the opening 222 of the panel 22. The top panel 10 forms a block 162 thereon.

Figure 3:
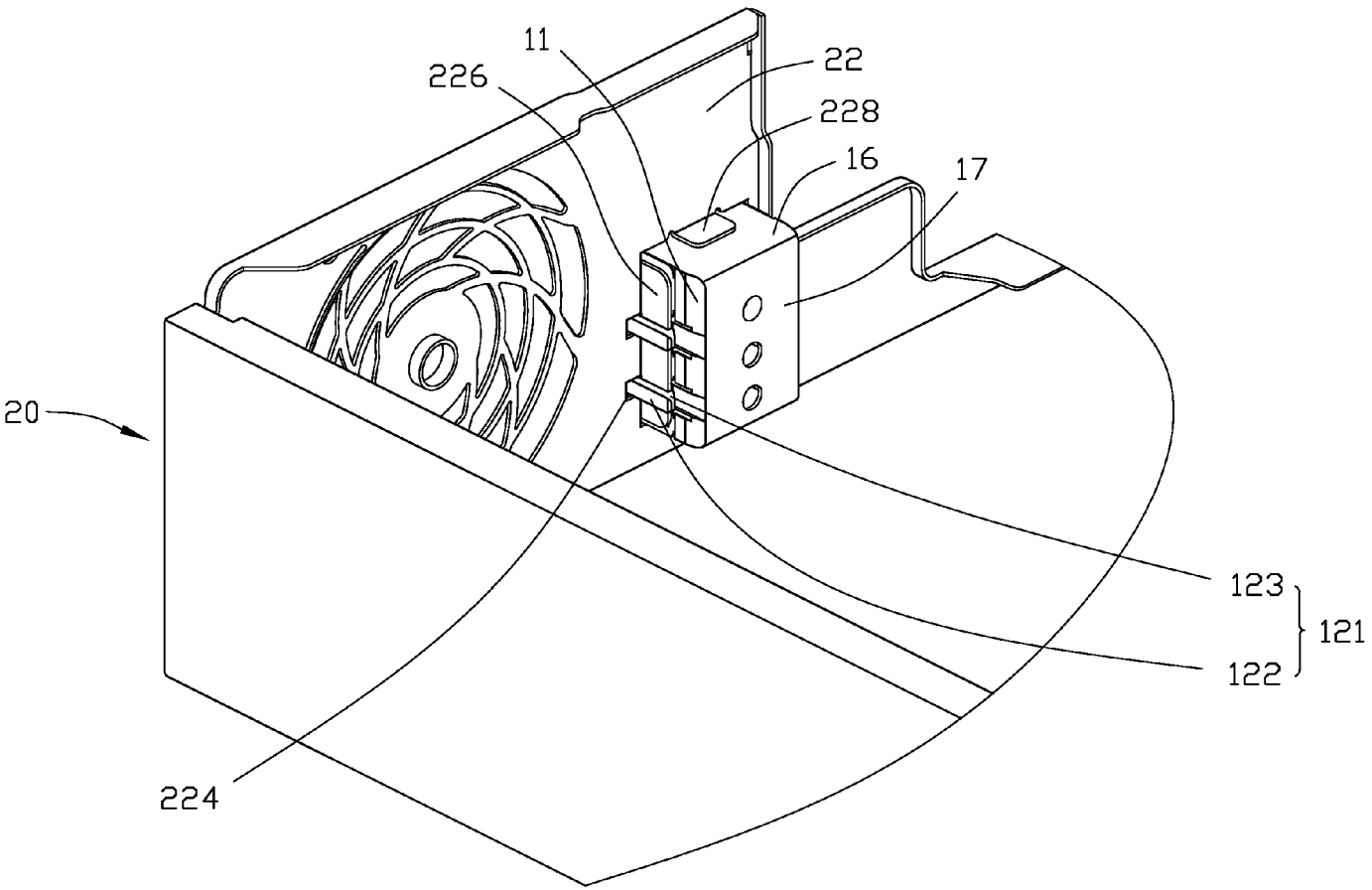
FIG. 3 is an assembled view of the shield being mounted on the panel.

Referring to FIGS. 1 and 3, in assembly of the shield 10 to the panel 22 of the enclosure 20, the shield 10 moves to the panel 22 with the inner panel 17 of the shield 10 in alignment with the opening 222 of the panel 22. An inner portion of the shield 10 extends through the opening 222. The pair of bent pieces 228 of the panel 22 is surface-contacted with the top panel 16 and bottom panel of the shield 10, and sandwich the shield 10 therebetween in an up and down direction. The pair of flanges 226 of the panel 22 is surface-contacted with the side panels 11 of the shield 10, and sandwich the shield 10 therebetween in a side-to-side direction. Simultaneously, the clasps 121 on the side panels 11 of the shield 20 extend through the corresponding holes 224 of the panel 22. The flanges 226 keep the clasps 121 a distance away from the shield 10 with the clasps 121 on one side of the flange 226 and the shield 10 on the other side. The barb 123 of each clasp 121 resists against an outer side of the flange 226 away from the opening 222 to resiliently bend the arm 122 of the corresponding clasp 121. The shield 10 is moved until the block 162 of the top panel 16 resists against an outer surface of the panel 22. The barbs 123 of the clasps 121 ride over the flanges 226, and rebound under the elastic force of the arms 122 and the connecting portions 124 to interlock with free edges of the flanges 226. Then, the shield 10 is mounted on the panel 22 with the operating portions 126 of the actuating members 12 of the shield 10 remaining outside of the enclosure 20.

In disassembly of the shield 10 from the panel 22, the operating portions 126 of the actuating members 12 are pressed toward the side panels 11 of the shield 10. The connecting portions 124 of the actuating members 12 are elastically bent to tilt the barbs 123 outwardly, and the barbs 123 disengage from the free edges of the flanges 226 of the panel 22. Then, the shield 10 can be pulled outwardly from the opening 222.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An assembly, comprising:

an enclosure for accommodating electronic devices therein, the enclosure comprising a panel extending along a side thereof, the panel defining an opening for communicating an inside of the enclosure to outside the enclosure, a flange extending from an edge of the opening into the inside of the enclosure with the opening located beside one side of the flange, the panel defining a hole beside the other side of the flange; and a connector module removably attachable to said panel, the connector module comprising a clasp on a side thereof corresponding to the hole, the connector module being capable of extending through the opening from outside the enclosure in such a manner that the clasp extends through the hole, and is held a distance from the connector module by the flange and engages with the flange to mount the connector module on the panel.

2. The assembly as described in claim 1, wherein the connector module comprises an actuating member on a side thereof, the actuating member comprises a main body parallel to the side of the connector module, and the clasp is formed on the main body.

3. The assembly as described in claim 2, wherein the main body forms an operating portion at an outer portion thereof, and a connecting portion at a middle portion thereof to connect to the connector module, and the clasp is formed at an inner portion thereof and is movable in a direction by operation of the operating portion in an opposite direction.

4. The assembly as described in claim 3, wherein the connecting portion is flexible.

5. The assembly as described in claim 3, wherein the operating portion remains outside of the enclosure when the connector module is mounted on the panel.

6. The assembly as described in claim 1, wherein the connector module comprises a block resisting against an outer surface of the panel when the connector module is mounted on the panel to retain the connector module in a direction perpendicular to the panel.

7. The assembly as described in claim 6, wherein the clasp extends through the hole in said direction perpendicular to the panel, and the clasp engages with the flange to retain the connector module in another direction opposing to said direction.

8. The assembly as described in claim 1, wherein another flange extends from an opposite edge of the opening, the two flanges are surface-contacted with two sides of the connector module respectively and sandwich the connector module therebetween in a normal direction when the connector module is mounted on the panel.

9. The assembly as described in claim 8, wherein a pair of bent pieces is formed from another two edges of the opening respectively, the pair of bents pieces are surface-contacted with another two sides of the connector module respectively, and sandwich the connector module therebetween in another normal direction different from said normal direction when the connector module is mounted on the panel.

10. An assembly, comprising:

a panel defining an opening for communicating opposite sides of the panel; and a connector module removably attachable to said panel, the connector module comprising a teeterboard-type actuating member on a side thereof, the actuating member comprising a main body, the main body forming an operating portion at an outer portion thereof, a connecting portion at a middle portion thereof to connect to the connector module, and a clasp at an inner portion thereof which is movable by operating the operating portion, the connector module being movable to enter into the opening with the clasp being engaged with an inside of the panel and the operating portion remaining outside of the panel, and the connector module being detachable from the panel by operating the operating portion to disengage the clasp from the panel wherein the panel defines a hole beside a side of the flange that is opposite to the opening, the clasp extends through the hole, and is separated from the connector module by the flange to engage with the flange to mount the module on the panel.

11. The assembly as described in claim 10, wherein a flange extends from an edge of the opening and is located on the inside of the panel.

12. The assembly as described in claim 10, wherein another flange extends from an opposite edge of the opening, the two flanges are surface-contacted with two sides of the connector module respectively, and sandwich the connector module therebetween in a normal direction.

13. The assembly as described in claim 12, wherein a pair of bent pieces is formed from another two edges of the opening respectively, the pair of bents pieces are surface-contacted with another two sides of the connector module respectively, and sandwich the connector module therebetween in another normal direction different from said normal direction.

14. The assembly as described in claim 10, wherein the connecting portion is flexible.

15. The assembly as described in claim 10, wherein the connector module comprises a block resisting against the outside of the panel when the connector module is mounted on the panel to prevent the connector module from further entering into the opening, the clasp engages with the inside of the panel to prevent the connector module from withdrawing from the opening.

16. An assembly comprising:

an enclosure comprising a panel defining a through opening therein, a flange extending inwardly from the panel; and a connector module slidably attached to the opening in a first direction perpendicular to the panel, an actuating member formed at one side of the connector module, the actuating member comprising an operating portion located at outside of the panel, a connecting portion interconnecting the actuating member with the connector module, and a clasp located at an inner side of the panel and engaged with the flange in a second direction opposing to the first direction, the operating portion being capable of being pressed in a third direction parallel to the panel to move the clasp in a fourth direction opposing to the third direction to disengage the clasp from the flange.

17. The assembly as claimed in claim 16, wherein the panel further defines a through hole, the hole and the opening are located at opposite sides of the flange, the connector module extends through the opening and the clasp extends through the hole.

18. The assembly as claimed in claim 17, wherein the enclosure further comprises another flange and a pair of pieces extending from the panel, said flange and said another flange sandwich the connector module therebetween in a left-and-right direction, the pair of pieces sandwich the connector module therebetween in an up-and-down direction.

19. The assembly as claimed in claim 17, wherein the connector module comprises a block resisting against an outer face of the panel in the first direction.

* * * * *